US010737894B2

(12) United States Patent
Shiokawa et al.

(10) Patent No.: US 10,737,894 B2
(45) Date of Patent: Aug. 11, 2020

(54) IMAGE FORMING APPARATUS AND CONVEYANCE CONTROL METHOD

(71) Applicant: Konica Minolta, Inc., Chiyoda-ku, Tokyo (JP)

(72) Inventors: Yasuo Shiokawa, Tokyo (JP); Yoshiteru Kawakami, Tokyo (JP); Takahiro Okubo, Kanagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/291,409

(22) Filed: Mar. 4, 2019

(65) Prior Publication Data

US 2019/0276257 A1 Sep. 12, 2019

(30) Foreign Application Priority Data

Mar. 6, 2018 (JP) ..... 2018-039673

(51) Int. Cl.
*B65H 7/02* (2006.01)
*G03G 15/00* (2006.01)
*B65H 9/00* (2006.01)

(52) U.S. Cl.
CPC ..... *B65H 7/02* (2013.01); *B65H 9/002* (2013.01); *G03G 15/5029* (2013.01); *G03G 15/5033* (2013.01); *G03G 15/5054* (2013.01); *G03G 15/6567* (2013.01)

(58) Field of Classification Search
CPC ..... B65H 7/02; B65H 9/002; G03G 15/5029; G03G 15/5033; G03G 15/5054; G03G 15/6567
USPC ..... 270/58.01, 56, 58.27
See application file for complete search history.

(56) References Cited

U.S. PATENT DOCUMENTS 5,797,070 A * 8/1998 Waki ..... G03G 15/0194 399/149
6,049,690 A * 4/2000 Nakayasu ..... G03G 15/5008 399/299
6,065,383 A * 5/2000 Takaishi ..... B26D 5/007 83/368
6,070,041 A * 5/2000 Nakayasu ..... G03G 15/5008 399/167
7,003,258 B2 * 2/2006 Adachi ..... G03G 15/6567 271/264
7,848,696 B2 * 12/2010 Peng ..... G03G 15/5062 271/226

(Continued)

FOREIGN PATENT DOCUMENTS

JP 2014133634 A 7/2014

*Primary Examiner* — Leslie A Nicholson, III
(74) *Attorney, Agent, or Firm* — Cantor Colburn LLP

(57) ABSTRACT

An image forming apparatus includes: a transfer section including a transfer body that transfers an image onto a sheet in a transfer nip; a belt position correction section that performs operation of correcting misalignment of a position in an axial direction of a transfer belt in the transfer nip; a sheet conveyance member that is provided on the upstream side of the transfer nip in a sheet conveyance direction and conveys the sheet; and a hardware processor that controls the sheet conveyance member so as to displace the sheet along a width direction of the sheet. The hardware processor controls displacement of the sheet conveyance member so as to follow the position in the axial direction of the transfer belt at the transfer nip.

12 Claims, 7 Drawing Sheets

(56) References Cited

U.S. PATENT DOCUMENTS

| | | | | |
|---|---|---|---|---|
| 8,213,847 | B2 * | 7/2012 | Murakami | G03G 15/6567 399/316 |
| 8,498,566 | B2 * | 7/2013 | Shoji | G03G 15/6558 399/162 |
| 8,676,083 | B2 * | 3/2014 | Takahashi | G03G 15/6567 399/124 |
| 9,365,375 | B2 * | 6/2016 | Aoki | G03G 15/65 |
| 9,581,927 | B2 * | 2/2017 | Iwakawa | G03G 15/0189 |
| 9,618,895 | B2 * | 4/2017 | Yoshida | G03G 15/657 |
| 10,401,776 | B2 * | 9/2019 | Okubo | G03G 15/5054 |

* cited by examiner

IMAGE FORMING APPARATUS AND CONVEYANCE CONTROL METHOD

CROSS REFERENCE TO RELATED APPLICATIONS

The present application claims priority under 35 U.S.C. § 119 to Japanese Patent Application No. 2018-039673 filed on Mar. 6, 2018 is incorporated herein by reference in its entirety.

BACKGROUND

Technological Field

The present invention relates to an image forming apparatus and a conveyance control method.

Description of Related Art

In general, an image forming apparatus (printer, copier, facsimile machine, or the like) utilizing an electrophotographic process technology irradiates (light exposes) a charged photoconductor drum (image bearing member) with laser light based on image data to form an electrostatic latent image. In the image forming apparatus, a toner is supplied from a developing section to the photoconductor drum on which the electrostatic latent image is formed, so that the electrostatic latent image is visualized to form a toner image. In the image forming apparatus, the toner image is primarily or secondarily transferred onto a sheet, the sheet is heated and pressed with a fixing nip of a fixing section, and the toner image is fixed on the sheet. In the image forming apparatus, a registration roller for correcting positional misalignment in the width direction of the sheet is provided on the upstream side of a transfer section that transfers the image to the sheet (for example, see Japanese Patent Application Laid-Open No. 2014-133634).

In a secondary transfer type image forming apparatus having a transfer body such as a primary transfer belt (also referred to as an intermediate transfer belt), a model not including a device for regulating a position in the width direction of the intermediate transfer belt may cause a case where the position in the width direction of the intermediate transfer belt at the secondary transfer nip is misaligned due to unexpected external force or the like. That is, in a case of the intermediate transfer belt type image forming system, a toner image is first transferred from the photoconductor drum to the intermediate transfer belt (primary transfer), and thereafter the toner image on the intermediate transfer belt is secondarily transferred onto sheet. Depending on alignment of a machine, a state of the intermediate transfer belt, or the like at the time of the secondary transfer, offset of the belt may occur and the intermediate transfer belt may skew. When such misalignment (skewing) of the intermediate transfer belt occurs, an image is not transferred to the originally intended correct position in the width direction of the sheet, which causes image misalignment. Further, a member may be damaged, for example, the intermediate transfer belt may be damaged.

Conventionally, in order to deal with such a problem, there is a technique in which, for example, a plate-shaped collar is abutted against an end portion in the width direction of an intermediate transfer belt, and the intermediate transfer belt is held at the abutting position. Further, there is a technique (so-called belt steering) of changing the alignment of the intermediate transfer belt itself to hold the intermediate transfer belt at a neutral position.

Here, in the belt steering technique, basically, the alignment of the intermediate transfer belt varies within a range in which image misalignment does not occur, but in some cases, a belt moves in the width direction perpendicular to the conveyance direction (axial direction) at the position of the secondary transfer nip, so that slight image misalignment may occur.

SUMMARY

An object of the present invention is to provide an image forming apparatus and a conveyance control method capable of suppressing occurrence of image defects caused by positional misalignment of a transfer body.

To achieve at least one of the abovementioned objects, according to an aspect of the present invention, an image forming apparatus reflecting one aspect of the present invention comprises:

a transferer comprising a transfer body that transfers an image onto a sheet at a transfer position;

a transfer body position corrector that performs operation of correcting misalignment of a position in an axial direction of the transfer body at the transfer position;

a sheet conveyance member that is provided on an upstream side of the transfer position in a sheet conveyance direction and conveys the sheet; and a hardware processor that controls the sheet conveyance member so as to displace the sheet along a width direction of the sheet, wherein the hardware processor controls displacement of the sheet conveyance member so as to follow the position in the axial direction of the transfer body at the transfer position.

To achieve at least one of the abovementioned objects, according to an aspect of the present invention, a conveyance control method reflecting one aspect of the present invention is a conveyance control method in an image forming apparatus, the image forming apparatus comprising: a transferer comprising a transfer body that transfers an image onto a sheet at a transfer position; a transfer body position corrector that performs operation of correcting misalignment of a position in an axial direction of the transfer body at the transfer position; and a sheet conveyance member that is provided on an upstream side of the transfer position in a sheet conveyance direction and conveys the sheet, the method comprising:

detecting the position in the axial direction of the transfer body at the transfer position; and displacing the sheet conveyance member so as to follow the detected position.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
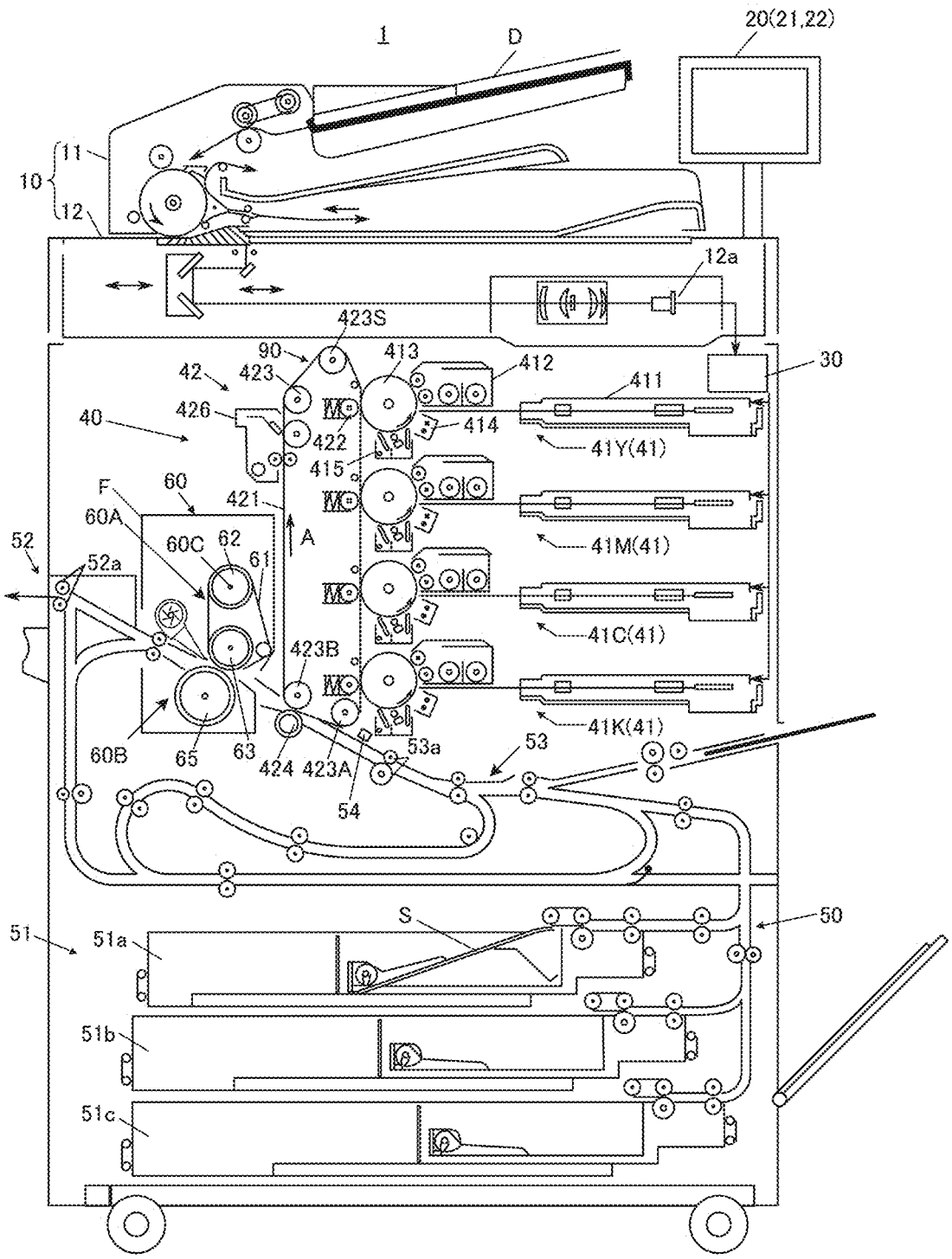
FIG. 1 is a diagram schematically showing the overall configuration of an image forming apparatus according to the present embodiment.
Figure 2:
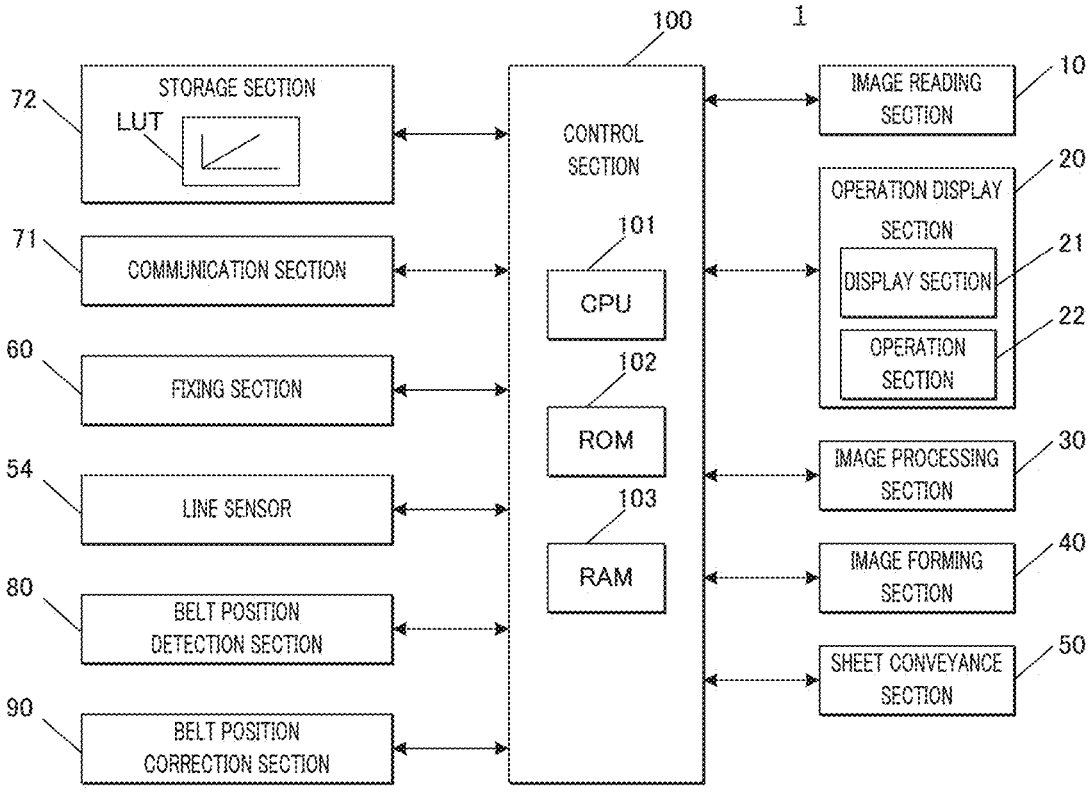
FIG. 2 is a diagram showing a main part of a control system of the image forming apparatus according to the present embodiment.

FIG. 1 is a diagram schematically showing the overall configuration of image forming apparatus 1 according to the present embodiment. FIG. 2 shows a main part of a control system of image forming apparatus 1 according to the present embodiment.

In image forming apparatus 1 of the present embodiment, a long sheet or non-long sheet is used as sheet S, and an image is formed on sheet S.

In the present embodiment, the long sheet is a sheet paper having a longer length in a conveyance direction than that of generally used sheets of A4 size, A3 size, or the like, and has a length that cannot be accommodated in sheet feed tray units 51*a* to 51*c* in a machine. Hereinafter, when simply referred to as "sheet", both long sheet and non-long sheet may be included.

Image forming apparatus 1 is an intermediate transfer type color image forming apparatus utilizing an electrophotographic process technology. That is, image forming apparatus 1 primarily transfers toner images of each color of yellow (Y), magenta (M), cyan (C), and black (K) formed on a photoconductor drum 413 to intermediate transfer belt 421, superimposes four color toner images on intermediate transfer belt 421, and then, secondarily transfers the toner images onto a sheet to form a toner image.

In image forming apparatus 1, the tandem system is adopted in which photoconductor drums 413 corresponding to the four colors of Y, M, C, and K are arranged in series in a traveling direction of intermediate transfer belt 421, and the toner images of each color are sequentially transferred to intermediate transfer belt 421 in a single procedure.

As shown in FIG. 2, image forming apparatus 1 includes image reading section 10, operation display section 20, image processing section 30, image forming section 40, sheet conveyance section 50, fixing section 60, belt position detection section 80, belt position correction section 90, control section 100, and the like.

Control section 100 includes a central processing unit (CPU) 101, a read only memory (ROM) 102, a random access memory (RAM) 103, and the like. CPU 101 reads a program corresponding to the processing content from the ROM 102, develops the program in the RAM 103, and cooperates with the developed program to centrally control the operation of each block of image forming apparatus 1. At this time, various types of data stored in storage section 72 is referred to. Storage section 72 includes, for example, a nonvolatile semiconductor memory (so-called flash memory) or a hard disk drive.

Control section 100 transmits and receives various types of data to and from an external device (for example, a personal computer) connected to a communication network such as a local area network (LAN), a wide area network (WAN), or the like via communication section 71. For example, control section 100 receives image data transmitted from an external device and causes a toner image to be formed on a sheet on the basis of the image data (input image data). Communication section 71 includes a communication control card such as a LAN card.

Image reading section 10 includes automatic document feeding device 11 called an auto document feeder (ADF), a document image scanning device (scanner) 12, and the like.

Automatic document feeding device 11 conveys document D placed on a document tray by a conveyance mechanism and sends document D to document image scanning device 12. Automatic document feeding device 11 can consecutively read images (including both sides) of a large number of documents D placed on the document tray at once.

Document image scanning device 12 optically scans a document conveyed onto a contact glass from automatic document feeding device 11 or a document placed on the contact glass, and forms an image of light reflected from the document onto a light receiving surface of a charge coupled device (CCD) sensor 12*a*, to read the document image. Image reading section 10 generates input image data on the basis of a reading result by document image scanning device 12. The input image data is subjected to predetermined image processing in image processing section 30.

Operation display section 20 includes, for example, a liquid crystal display (LCD) with a touch panel, and functions as display section 21 and operation section 22. Display section 21 displays various types of operation screen, image state display, operation status of each function, or the like according to a display control signal input from control section 100. Operation section 22 includes various types of operation key such as a numeric key pad, or a start key, accepts various types of input operation by a user, and outputs an operation signal to control section 100.

Image processing section 30 includes a circuit or the like for performing digital image processing according to initial setting or user setting on the input image data. For example, under the control of control section 100, image processing section 30 performs tone correction on the basis of tone correction data (tone correction table LUT) in storage section 72. In addition to the gradation correction, image processing section 30 applies various types of correction processing such as tone correction, or shading correction, compression processing, or the like, to the input image data. Image forming section 40 is controlled on the basis of the image data subjected to these processes.

Image forming section 40 includes image forming units 41Y, 41M, 41C, and 41K that form images with color toners of Y component, M component, C component, and K component on the basis of the input image data, intermediate transfer unit 42, and the like.

Image forming units 41Y, 41M, 41C, and 41K for Y component, M component, C component, and K component have a similar configuration. For convenience of illustration and explanation, the same constituent elements are denoted by the same reference numerals, and when distinguishing them, Y, M, C, or K is added to the reference numerals. In FIG. 1, only the constituent elements of image forming unit 41Y for the Y component are denoted by reference numerals, and the reference numerals of the constituent elements of the other image forming units 41M, 41C, 41K are omitted.

Image forming unit 41 includes exposing device 411, developing device 412, photoconductor drum 413, charging device 414, drum cleaning device 415, and the like.

Photoconductor drum 413 is a negative charge type organic photo-conductor (OPC) having an under coat layer (UCL), a charge generation layer (CGL), and a charge transport layer (CTL) sequentially laminated in this order on a circumferential surface of an aluminum conductive cylindrical body (aluminum element tube), for example. The charge generation layer is made of an organic semiconductor in which a charge generation material (for example, a phthalocyanine pigment) is dispersed in a resin binder (for example, polycarbonate), and generates a pair of positive and negative charges upon light exposure by the exposing device 411. The charge transport layer is formed by dispersing a hole transport material (electron applying nitrogen-containing compound) in a resin binder (for example, polycarbonate resin), and transports positive charges generated in the charge generation layer to the surface of the charge transport layer.

Control section 100 controls a driving current supplied to a driving motor (not shown) that rotates the photoconductor drum 413 to rotate the photoconductor drum 413 at a constant circumferential speed (linear velocity).

Charging device 414 uniformly charges the surface of the photoconductor drum 413 having an optical conductivity to negative polarity. Exposing device 411 includes, for example, a semiconductor laser, and irradiates the photoconductor drum 413 with laser lights corresponding to images of color components. As a result, an electrostatic latent image of each color component is formed on the surface of the photoconductor drum 413 due to a potential difference with the surroundings.

Developing device 412 is, for example, a two-component developing type developing device, and adheres toners of each color component to the surface of the photoconductor drum 413 to visualize the electrostatic latent image to form a toner image.

Drum cleaning device 415 has a cleaning member or the like that is in sliding contact with the surface of the photoconductor drum 413. Drum cleaning device 415 removes a transfer residual toner remaining on the surface of the photoconductor drum 413 after the primary transfer by a cleaning blade.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is formed of an endless belt, and is looped around the plurality of support rollers 423. At least one of the plurality of support rollers 423 includes a driving roller, and the others include a driven roller. For example, it is preferable that a roller 423A arranged in a downstream side of primary transfer roller 422 for the K component in the belt traveling direction is a driving roller. This makes it easier to keep the traveling speed of the belt at the primary transfer section constant. As the driving roller 423A rotates, intermediate transfer belt 421 travels at a constant speed in the direction of arrow A.

Primary transfer roller 422 is arranged on an inner circumferential surface side of intermediate transfer belt 421 so as to face the photoconductor drum 413 of each color component. Primary transfer roller 422 is pressed against and brought into contact with the photoconductor drum 413 with intermediate transfer belt 421 in between, so that a primary transfer nip for transferring a toner image from the photoconductor drum 413 to intermediate transfer belt 421 is formed.

Secondary transfer roller 424 is arranged on the outer peripheral surface side of intermediate transfer belt 421 so as to face a backup roller 423B arranged on the downstream side in the belt traveling direction of the driving roller 423A. Secondary transfer roller 424 is pressed against and brought into contact with the backup roller 423B with intermediate transfer belt 421 in between, so that a secondary transfer nip for transferring a toner image from the intermediate transfer belt 421 to sheet S is formed.

The secondary transfer nip including intermediate transfer belt 421, the backup roller 423B, and secondary transfer roller 424 corresponds to the "transfer position" of the present invention.

Next, the configuration of belt position correction section 90 will be described. In the present embodiment, the uppermost support roller 423 among the plurality of support rollers 423 supporting intermediate transfer belt 421 functions as a steering roller 423S which forms a part of belt position correction section 90. The steering roller 423S is configured to be able to reciprocate in the axial direction of the roller, and is connected to a drive source such as an actuator (not shown) which forms a part of belt position correction section 90. Control section 100 outputs a control signal to the drive source to move the steering roller 423S in the axial direction, so as to perform control of correcting the positional misalignment of intermediate transfer belt 421 in the axial direction.

In a specific example, control section 100 slightly oscillates the steering roller 423S in the axial direction such that intermediate transfer belt 421 slightly moves in front of and behind (front and depth direction of the apparatus) of a predetermined position (see reference position $BP_0$ shown in FIG. 4A and FIG. 4B) to correct the position of intermediate transfer belt 421. Such control of the belt steering keeps the position in the axial direction of intermediate transfer belt 421 (the position in front/depth of the apparatus) within a certain range.

When intermediate transfer belt 421 passes through the primary transfer nip, the toner images on the photoconductor drum 413 are sequentially superimposed and primarily transferred onto intermediate transfer belt 421. Specifically, a primary transfer bias is applied to primary transfer roller 422, and a charge having a polarity opposite to that of the toner is applied to the side of intermediate transfer belt 421 in contact with primary transfer roller 422, so that the toner image is electrostatically transferred onto intermediate transfer belt 421.

Thereafter, when the sheet passes through the secondary transfer nip, the toner image on intermediate transfer belt 421 is secondarily transferred onto the sheet. Specifically, a secondary transfer bias is applied to secondary transfer roller 424, and a charge having a polarity opposite to that of the toner is applied to the side of the sheet in contact with secondary transfer roller 424, so that the toner image is electrostatically transferred onto the sheet. The sheet on which the toner image has been transferred is conveyed toward fixing section 60.

Belt cleaning device 426 has a belt cleaning blade or the like in sliding contact with the surface of intermediate transfer belt 421, and removes a transfer residual toner remaining on the surface of intermediate transfer belt 421 after the secondary transfer.

Fixing section 60 includes upper fixing section 60A having a fixing surface side member arranged on the fixing surface side of the sheet, lower fixing section 60B having a back surface side support member arranged on the surface side opposite to the fixing surface of the sheet, heating source 60C, and the like. The back surface side support member is pressed against and brought into contact with the fixing surface side member, so that a fixing nip for nipping and conveying the sheet is formed.

Upper fixing section 60A has endless fixing belt 61, heating roller 62, upper pressure roller 63, and the like as a fixing surface side member (belt heating method). Fixing belt 61 is stretched with a predetermined belt tension (for example, 400 N) between heating roller 62 and upper pressure roller 63.

Lower fixing section 60B has, for example, lower pressure roller 65 as a back surface side support member (roller pressing method). Lower pressure roller 65 is pressed against and brought into contact with upper pressure roller 63 with a predetermined fixing load via fixing belt 61. In this manner, a fixing nip that nips and conveys sheet S is formed between fixing belt 61 and the lower pressure roller 65.

In fixing section 60, the toner image is secondarily transferred, and the conveyed sheet is heated and pressurized at the fixing nip to fix the toner image on the sheet. Fixing section 60 is arranged as a unit in fixing device F.

Sheet conveyance section 50 includes sheet feed section 51, sheet ejection section 52, conveyance path section 53, and the like. Sheet S (standard sheet, special sheet) identified on the basis of basis weight (stiffness), size, or the like is accommodated in each of three sheet feed tray units 51*a* to 51*c* constituting sheet feed section 51, for each preset type. Conveyance path section 53 has a plurality of conveyance rollers such as a registration roller pair 53*a*, a double-sided conveyance path for formation of images on both sides of the sheet, and the like. Registration roller pair 53*a* corresponds to the "sheet conveyance member" of the present invention.

Registration roller pair 53*a* corrects a position in the width direction of sheet S under the control of control section 100. Specifically, when sheet S is nipped by the nip of registration roller pair 53*a*, control of registration displacement is performed in which registration roller pair 53*a* moves in the width direction to move sheet S, so that the position of sheet S in the width direction is corrected. Control contents of such registration displacement will be described later.

After correcting the position of sheet S in the width direction, registration roller pair 53*a* is separated before sheet S completes passing registration roller pair 53*a*, that is, in the middle of conveyance of sheet S, and returned to the position of before moving. Then, after the rear end of sheet S passes through registration roller pair 53*a*, registration roller pair 53*a* is pressure bonded again.

The conveyance speed of sheet S in registration roller pair 53*a* is set to be higher than the conveyance speed of sheet S in the secondary transfer nip formed by the backup roller 423B and secondary transfer roller 424 under the control of control section 100.

A line sensor 54 is arranged on the upstream side of the secondary transfer nip on the downstream side of registration roller pair 53*a* in the sheet conveyance direction. Line sensor 54 is a sensor in which photoelectric conversion elements are arranged in a line shape, and detects offset of sheet S in the width direction, that is, misalignment from a reference position.

Sheet S accommodated in sheet feed tray units 51*a* to 51*c* are sent one by one from the uppermost portion and are conveyed to image forming section 40 by conveyance path section 53. At this time, registration roller pair 53*a* corrects the inclination of fed sheet S and adjusts the conveyance timing.

In image forming section 40, the toner image of intermediate transfer belt 421 is secondarily transferred collectively to one surface of sheet S, and a fixing step is performed in fixing section 60. Sheet S on which an image has been formed is ejected to the outside of the machine by sheet ejection section 52 having sheet ejection roller 52*a*. In double-sided printing, after sheet S on which image formation on a first surface is performed is reversed between the front and back through the double-sided conveyance path, the toner image is secondarily transferred and fixed on a second surface, and then, sheet S is ejected to the outside of the machine by sheet ejection section 52.

Basically, in image forming apparatus 1 provided with belt position correction section 90 (that is, the belt steering mechanism) as described above, the alignment (the position in the width direction) of intermediate transfer belt 421 varies within the range in which image misalignment does not occur. On the other hand, for example, due to an unexpected external force action or the like, intermediate transfer belt 421 may move relatively largely in the width direction (axial direction) perpendicular to the conveyance direction at the position of the secondary transfer nip, that is, the positional misalignment may occur in the width or axial direction. In such a case, even if a side end (alignment in the width direction) of sheet S to be conveyed is set to the correct position by the displacement control of registration roller pair 53*a*, slight image misalignment may occur.

Figure 3:
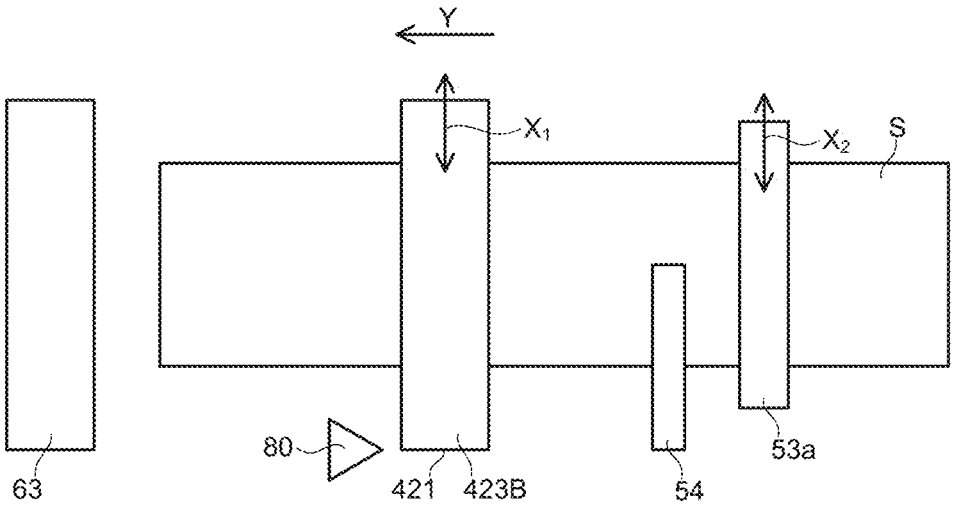
FIG. 3 is a diagram for explaining a configuration of a belt position detection section and operation of registration displacement control in the present embodiment.

In the present embodiment, basically, the displacement amount of the registration roller pair 53*a* in registration displacement control is determined according to the position in the axial direction of intermediate transfer belt 421. Specifically, as shown in FIG. 3, belt position detection section 80 is provided, the belt position detection section detecting the end portion (position in the axial direction) of intermediate transfer belt 421 at the position of the secondary transfer nip. Belt position detection section 80 may be, for example, a known optical device having a light irradiation section (light emitting element) and a light receiving section (light sensor or the like) and detecting the end portion of intermediate transfer belt 421 by an optical method. Control section 100 inputs a detection signal of belt position detection section 80, specifies the position of the end portion of intermediate transfer belt 421 in the secondary transfer nip (furthermore, the presence or absence of positional misalignment or the like) from the detection signal, and controls the displacement of registration roller pair 53*a* so as to follow the position of the end portion of specified intermediate transfer belt 421.

That is, from the detection result of belt position detection section 80, control section 100 displaces the registration roller pair 53*a* in the direction ($X_2$ direction orthogonal to the conveyance direction) same as the moving direction of intermediate transfer belt 421 moving in the direction indicated by double-headed arrow X in FIG. 3 ($X_1$ orthogonal to the conveyance direction (see arrow Y)) along with the operation of belt position correction section 90 as described above.

Figure 4A:
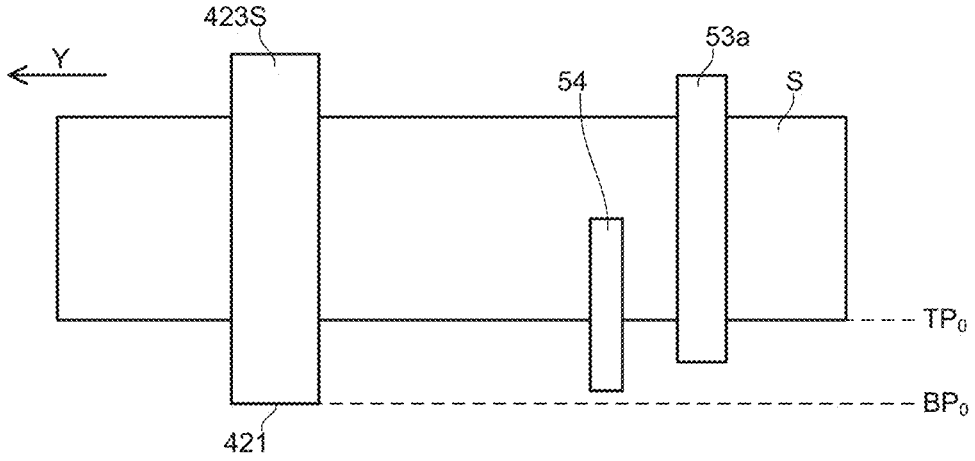
FIG. 4A and FIG. 4B are diagrams for explaining a normal target position and a changed target position of an end portion of the intermediate transfer belt and a side end of the sheet.
Figure 4B:
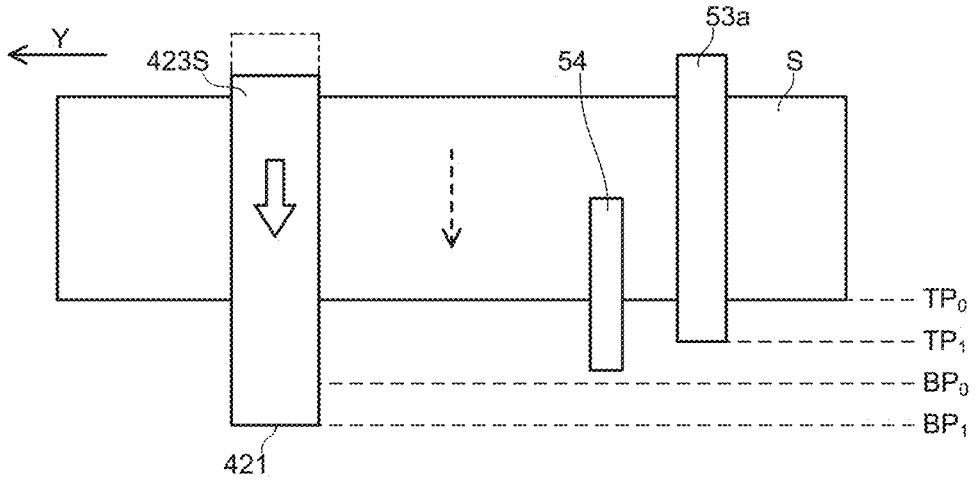

The operation of the present embodiment will be described in more detail with reference to FIG. 4A and FIG. 4B. FIG. 4A shows reference position $BP_0$ at the end portion of intermediate transfer belt 421 during printing in the normal or ordinally state, and normal target position $TP_0$ at the sheet side end in the registration displacement control. On the other hand, FIG. 4B is a diagram for explaining the operation when the steering roller 423S is largely moved in the axial direction (in the example shown in FIG. 4B, toward the front side of the apparatus) by belt position correction section 90. For ease of understanding, the amount of movement of the steering roller 423S, intermediate transfer belt 421, or the like, is exaggerated in FIG. 4B.

As shown in FIG. 4A, in the normal state, the displacement operation in the axial direction of the steering roller 423S in belt position correction section 90 is performed in a very small amount as described above. In this case, the end portion of intermediate transfer belt 421 at the position of the secondary transfer nip hardly moves from reference position $BP_0$ shown in FIG. 4A. Therefore, in this case, control section 100 may control the displacement of registration roller pair 53*a* so that the end portion of sheet S matches with normal target position $TP_0$.

On the other hand, for example, as shown in FIG. 4B, the steering roller 423S and intermediate transfer belt 421 (the upper portion) move (skew) in the axial direction (in this example, the front side of the apparatus indicated by the outlined arrow) due to some external force or the like, the upper portion wound around the steering roller 423S of intermediate transfer belt 421 moves in the same direction as the steering roller 423S moves. Movement of the upper portion of intermediate transfer belt 421 due to the movement of the steering roller 423S is promptly (almost simultaneously) propagated to the region of the secondary transfer nip, and a force causing sheet S nipped in the secondary transfer nip to move in the axial direction (in this example, toward the front side of the apparatus) is generated (see the dotted arrows).

In this way, when the end portion of the upper region of intermediate transfer belt 421 is moved from position $BP_0$ to position $BP_1$ in FIG. 4B due to the movement of the steering roller 423S, the end portion of intermediate transfer belt 421 in the secondary transfer nip also promptly moves to position $BP_1$. At this time, control section 100 performs control to move the target position on the side end of sheet S from normal position $TP_0$ to position $TP_1$, and displace registration roller pair 53*a* and sheet S.

By performing such control, it is possible to prevent sheet S from skewing due to positional misalignment (skewing or the like) of intermediate transfer belt 421, and eventually, prevent a toner image to be secondarily transferred onto sheet S from being misaligned.

In the present embodiment, line sensor 54 arranged on the downstream side of registration roller pair 53*a* detects the side end of sheet S, and belt position detection section 80 detects the end portion of intermediate transfer belt 421 at the position of the secondary transfer nip (see FIG. 3). Therefore, in the present embodiment, the displacement mode (displacement amount and displacement speed) of registration roller pair 53*a* is determined on the basis of a plurality of pieces of information, that is, the side end position of sheet S and the end position of intermediate transfer belt 421, and the accuracy of the transfer position of the toner image to be printed on sheet S can be improved.

In FIG. 4B, a case is illustrated in which the target position of displacement (side end of sheet S) in the registration displacement control is changed (from $TP_0$ to $TP_1$) by the same amount as the movement amount ($BP_1$-$BP_0$) of the end portion position of intermediate transfer belt 421. On the other hand, the change amount of the target position of displacement (that is, the position of $TP_1$) and the displacement speed of registration roller pair 53*a* in the registration displacement control are preferably changed according to the sheet type (stiffness or the like) of sheet S, the environment such as temperature and humidity, the use situation (durability or the like) of registration roller pair 53*a*.

That is, as described above, the steering amount of intermediate transfer belt 421 by belt position correction section 90 (the steering roller 423S) is set within a certain range of a degree with which image misalignment does not occur, during normal operation in which no unexpected trouble such as skewing has not occurred. On the other hand, the displacement amount and displacement speed of registration roller pair 53*a* required for registration displacement control for aligning the side end of sheet S can be changed depending on the use situation as described above. For example, in general, as the degree of deterioration of registration roller pair 53*a* increases, sheet S becomes easy to slide from registration roller pair 53*a* at the time of displacement of registration roller pair 53*a*. As the stiffness of sheet S decreases, or as the temperature and humidity increases, sheet S becomes easy to slide from registration roller pair 53*a* at the time of displacement of registration roller pair 53*a*.

Then, control section 100 determines the change amount of the target position of displacement and the displacement mode (displacement speed or the like) of registration roller pair 53*a* in the registration displacement control with respect to the movement amount of the end portion position of intermediate transfer belt 421 according to the sheet type (stiffness or the like) of sheet S, the environment such as temperature and humidity, the use situation (durability or the like) of registration roller pair 53*a*. With such individual determination, it is possible to set the displacement amount (shift amount) of sheet S to the amount corresponding to the movement amount of the end portion position of intermediate transfer belt 421 even when the usage conditions change, and the accuracy of the image printed on sheet S can be further improved.

If the degree of deterioration of registration roller pair 53*a* is considerably advanced, the amount of sliding of sheet S at the time of displacement may not be constant in some cases. Therefore, for example, when the side end of sheet S does not reach the target position, or when the time until reaching the target position becomes longer to some extent, control section 100 displays that the maintenance or replacement of registration roller pair 53*a* should be performed on display section 21 or the like to urge the user to perform cleaning, replacement, or the like of the parts.

Figure 5:
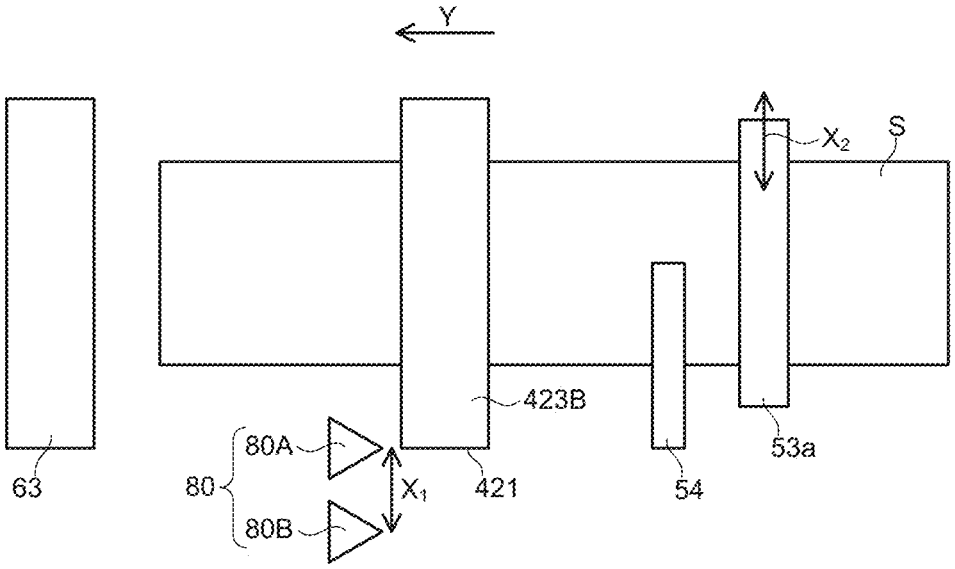
FIG. 5 is a diagram for explaining another configuration example of the belt position detection section.

FIG. 5 is a diagram for explaining another configuration example and another control example of belt position detection section 80. Belt position detection section 80 shown in FIG. 5 includes two optical devices described above with reference to FIG. 3 arranged along the axial direction of the backup roller 423B, and includes detection section 80A on the depth side of the apparatus and detection section 80B on the front side of the apparatus. In the configuration example of FIG. 5, the allowable range of the positional misalignment of intermediate transfer belt 421 is defined by the arrangement of detection sections 80A and 80B. In other words, double-headed arrow $X_1$ shown in FIG. 5 indicates the allowable range amount of the belt position misalignment and is shown as exaggeratedly long for easy understanding.

In a specific example of the configuration example shown in FIG. 5, control section 100 specifies the position of the end portion of intermediate transfer belt 421 from the strengths of the detection signals of detection sections 80A and 80B or the like, and changes the target position (see $TP_0$ in FIG. 4A and FIG. 4B) of the side end of sheet S in registration displacement control according to the specified end portion position. Control section 100 controls the operation of belt position correction section 90 so that the position of the end portion of intermediate transfer belt 421 does not deviate from the above-mentioned allowable range.

In a specific example of the configuration shown in FIG. 5, when the position of the end portion of intermediate transfer belt 421 and the position of the end portion of sheet S detected by line sensor 54 are relatively changed, control section 100 causes correction of the displacement amount (displacement speed of registration roller pair 53*a*, or the like) in the registration displacement.

Specifically, when the degree of positional displacement of intermediate transfer belt 421 detected by belt position detection section 80 is large, and intermediate transfer belt 421 is largely misaligned by belt position correction section 90, the image transferred at the secondary transfer nip and the position in the width direction of sheet S may not match. In addition, even if sheet S is of the same type and the same lot, there is a variation in characteristics such as stiffness for each sheet, so that, when registration roller pair 53*a* is displaced on the basis of only the position information of the end portion of intermediate transfer belt 421, the variation of sheet S for each sheet cannot be solved.

In order to deal with the above problem, control section 100 performs the control of the registration displacement for sheet position alignment of aligning the position of the side end of sheet S to a target position on the basis of the detection result by line sensor 54 arranged on the upstream side of the secondary transfer nip and downstream side of registration roller pair 53*a*, even after sheet S enters the secondary transfer nip.

Control section 100 corrects the target position ($TP_0$) of the side end of sheet S in the registration displacement on the basis of the detection result by belt position detection section 80 (that is, the position information of the end portion of intermediate transfer belt 421). Such performing of control of the registration displacement can match the position in the width direction of the image transferred at the secondary transfer nip with the position in the width direction of sheet S more closely.

Next, referring to FIG. 6 and FIG. 7, description will be made on switching of control of registration displacement or the like before and after the tip end of sheet S in the conveyance direction enters the secondary transfer nip. The example in FIG. 6 and FIG. 7 are similar to the configuration shown in FIG. 4A, FIG. 4B and FIG. 5 except that a line sensor similar to the above-described line sensor 54 is used as belt position detection section 80.

Figure 6:
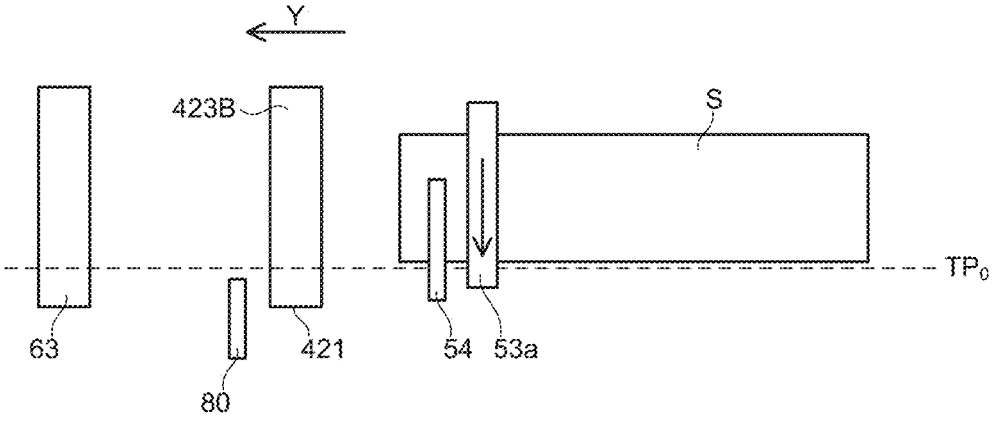
FIG. 6 is a diagram for explaining another configuration example of the belt position detection section and an example of registration displacement control before the sheet enters the secondary transfer nip.

FIG. 6 shows a conveyance state before sheet S reaches the secondary transfer nip. At this time, control section 100 monitors the detection signal of line sensor 54 and controls the displacement of registration roller pair 53*a* so as to perform normal control of the registration displacement. By such control, before the tip end of sheet S in the conveyance direction is nipped by registration roller pair 53*a* and enters the secondary transfer nip, displacement operation is performed so that the side end of sheet S is always aligned with a certain target position ($TP_0$). In the example shown in FIG. 6, sheet S is misaligned to the depth side of the apparatus. In this case, control section 100 monitors the detection signal of line sensor 54, and performs control for displacing registration roller pair 53*a* in the front side of the apparatus (the arrow direction in FIG. 6) until the side end of sheet S matches with the target position ($TP_0$).

Figure 7:
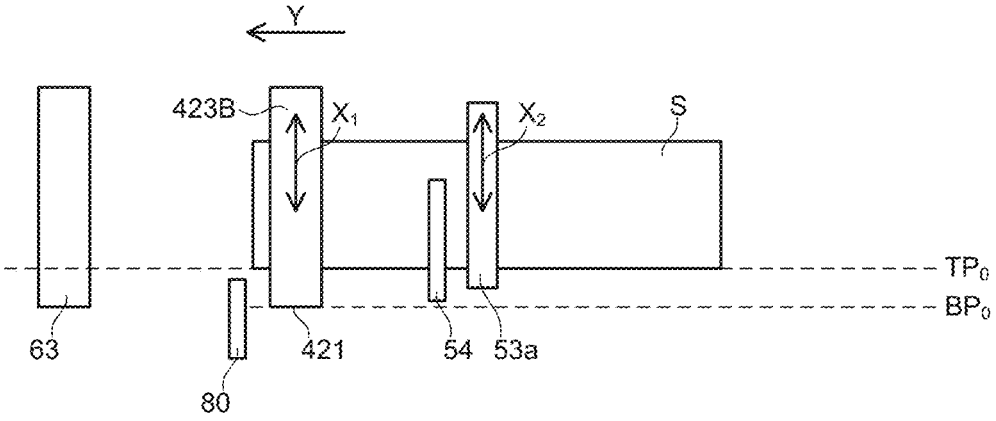
FIG. 7 is a diagram for explaining an example of registration displacement control after the sheet enters the secondary transfer nip in the configuration example shown in FIG. 6.

FIG. 7 shows a conveyance state after the tip end in the conveyance direction of sheet S enters the secondary transfer nip. At this time, control section 100 monitors the detection signal of belt position detection section 80, specifies misalignment (direction and amount) from the normal position ($BP_0$) of the end portion of intermediate transfer belt 421, and controls belt position correction section 90 such that the misalignment is solved.

In a specific example, control section 100 displaces the target position of the side end of sheet S from $TP_0$ with a value corresponding to the misalignment from the normal position ($BP_0$) of the end portion of intermediate transfer belt 421 to displace registration roller pair 53*a*. More specifically, as the belt steering operation is performed by belt position correction section 90, the misalignment value (direction and amount) from the normal position ($BP_0$) of the end portion of intermediate transfer belt 421 dynamically changes, so that control section 100 determines the target position (displacement amount from $TP_0$) of the side end of sheet S according to the change. Therefore, the target position of the side end of sheet S in the registration displacement also dynamically changes.

Here, as shown in FIG. 7, in a state where sheet S is conveyed (nipped) by both of the secondary transfer nip and registration roller pair 53*a*, a displacement stress caused by registration roller pair 53*a* is transmitted through sheet S to intermediate transfer belt 421 (see arrows $X_2$ and $X_1$ in FIG. 7). Therefore, in such a case, the operation for correcting the position of intermediate transfer belt 421 in the axial direction is related to not only belt position correction section 90 (the steering roller 423S) but also the displacement operation of registration roller pair 53*a*.

Therefore, regarding the registration displacement control during the correction of the position of intermediate transfer belt 421, the following various modes of control can be considered.

In a specific example, as described above, when the position of the intermediate transfer belt 421 detected by belt position detection section 80, and the position of the end portion of sheet S detected by line sensor 54 are relatively changed, control section 100 corrects the displacement amount of registration roller pair 53*a*.

Specifically, when the degree of positional misalignment of intermediate transfer belt 421 detected by belt position detection section 80 is large, and intermediate transfer belt 421 is largely moved in the axial direction through belt position correction section 90 (displacement of the steering roller 423S), the image transferred at the secondary transfer nip and the position in the width direction of sheet S may not match. In addition, even if sheet S is of the same type and the same lot, there is a variation in characteristics such as stiffness for each sheet, so that, when registration roller pair 53*a* is displaced on the basis of only the position information of the end portion of intermediate transfer belt 421, printing corresponding to the variation of sheet S cannot be performed.

In order to deal with the above problem, control section 100 performs the control of the registration displacement for sheet position alignment of aligning the position of the side end of sheet S to a target position ($TP_0$) using the detection result by line sensor 54 arranged on the upstream side of the secondary transfer nip and downstream side of registration roller pair 53*a*, even after sheet S enters the secondary transfer nip.

When positional misalignment (skewing or the like) of the end portion of intermediate transfer belt 421 occurs due to the detection result of belt position detection section 80 or the like, control section 100 moves intermediate transfer belt 421 to the axial direction (direction in which the positional misalignment is corrected) through the displacement of the steering roller 423S. At this time, in the displacement control of registration roller pair 53*a*, control section 100 corrects the target position of the side end of sheet S detected by line sensor 54 to displace the target position from the normal reference position (change the target position along the axial direction) such that the target position is changed according to the position of intermediate transfer belt 421 in the axial direction. As a specific example, control section 100 first displaces the target position of the side end of sheet S to a position (see FIG. 4B) in the same direction as the positional misalignment direction of intermediate transfer belt 421, and then, corrects the target position of the side end of sheet S to be close to the normal reference position (TN) as the position of the end portion of intermediate transfer belt 421 approaches the normal position (see $BP_0$ in FIG. 4A and FIG. 4B).

As described above, when the control of the registration displacement during the correction of the position of intermediate transfer belt 421 by the steering roller 423S is performed by using a plurality of pieces of position information (position information of the sheet side end and the belt end portion) and a plurality of reference positions, and with the control of the alignment of sheet S, it is possible to match the position in the width direction of the image transferred at the secondary transfer nip with the position in the width direction of sheet S more preferably.

Figure 8:
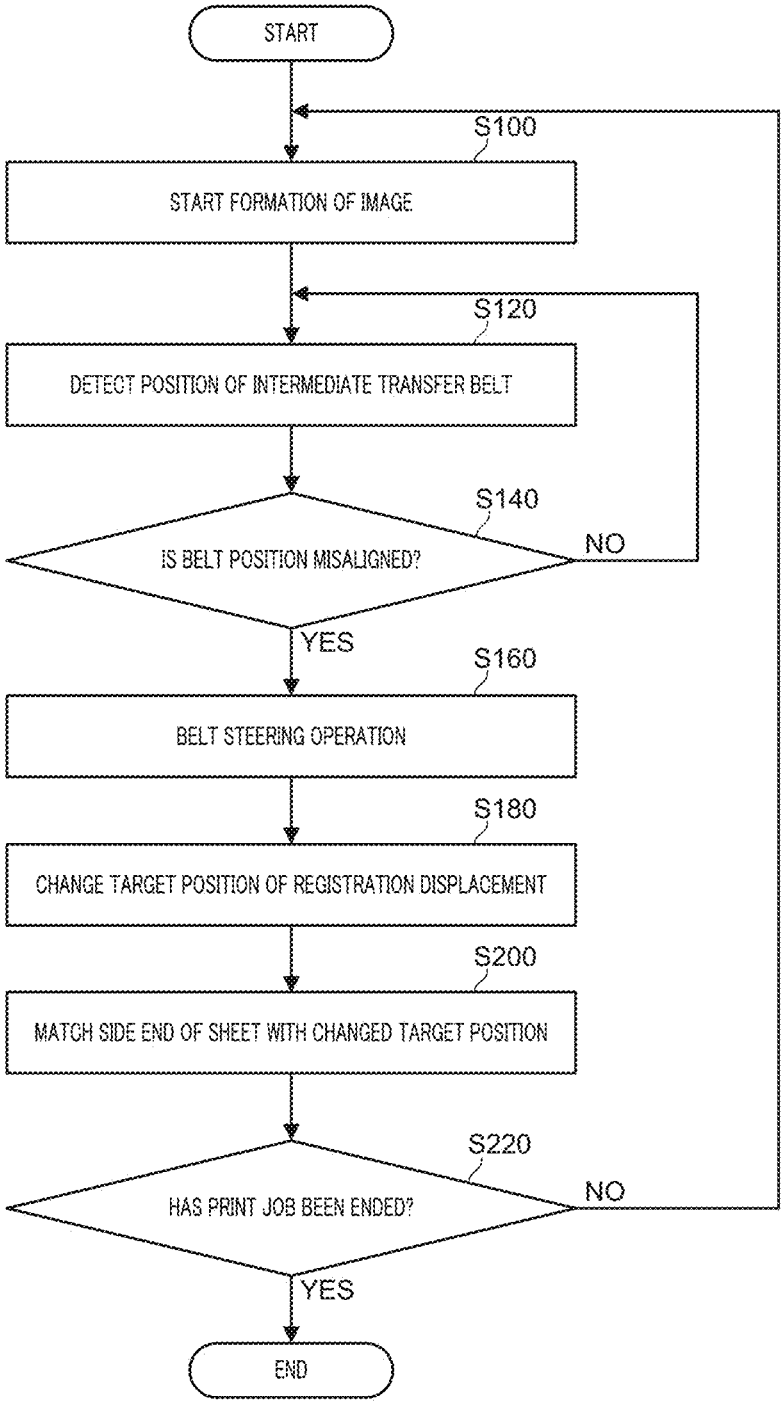
FIG. 8 is a flowchart showing an example of control relating to registration displacement in the image forming apparatus of the present embodiment.

Hereinafter, an example of the operation related to the displacement control of registration roller pair 53*a* in image forming apparatus 1, and eventually, of sheet S will be described. FIG. 8 is a flowchart showing an operation example of displacement control in image forming apparatus 1 having the configuration that has been described in FIG. 6 and FIG. 7. The processing shown in FIG. 8 is an example of control when sheet S is a long sheet, and is performed for each sheet S on which an image is formed, in performing of a print job.

Upon performing of the print job, control section 100 acquires the input image data and the user setting information, and controls each section so as to start the processing of conveyance of sheet S and formation of an image (toner image) to be printed on sheet S (step S100). Here, until the tip end of sheet S in the conveyance direction enters the secondary transfer nip, as described above with reference to FIG. 6, control section 100 performs normal registration displacement control for matching the side end of sheet S with the target position (TN) on the basis of the detection result by line sensor 54. When the tip end of sheet S in the conveyance direction enters the secondary transfer nip, control section 100 proceeds to step S120.

In step S120, control section 100 starts the processing of detecting the position of intermediate transfer belt 421 from the detection signal of belt position detection section 80. In subsequent step S140, control section 100 determines whether the end portion of intermediate transfer belt 421 has misaligned from normal position $BP_0$ (see FIG. 7). When control section 100 determines that the end portion of intermediate transfer belt 421 is not misaligned from normal position $BP_0$ (NO in step S140), control section 100 repeats the position detection of intermediate transfer belt 421 (step S120) and the determination of step S140. When control section 100 determines that the end portion of intermediate transfer belt 421 has misaligned from normal position $BP_0$ (YES in step S140), the process proceeds to step S160.

In step S160, control section 100 controls belt position correction section 90 to perform the above-described belt steering operation. In subsequent step S180, control section 100 changes the target position of the side end of sheet S in the registration displacement control so as to displace the target position from normal position $TP_0$ by an amount corresponding to the movement amount of intermediate transfer belt 421 by the belt steering operation (see position $TP_1$ in FIG. 4B). In step S200, control section 100 controls the displacement of registration roller pair 53*a* so that the side end of sheet S matches with the changed target position on the basis of the detection signal of line sensor 54.

Such control can prevent the image transfer position on sheet S from being misaligned in the width direction when the positional misalignment of intermediate transfer belt 421 in the width direction occurs.

In step S220, control section 100 determines whether the print job has ended. As a result of the determination, when the print job has not ended (NO in step S220), control section 100 returns to step S100 to perform printing processing such as conveyance of next sheet S and formation of an image. On the other hand, when control section 100 determines that the print job has ended (YES in step S220), control section 100 ends the above-described series of processes.

Hereinafter, modifications of the above-described embodiment will be described.

In the configuration examples shown in FIG. 6 and FIG. 7, a line sensor is used as belt position detection section 80, and the line sensor detects the position of the end portion of intermediate transfer belt 421 at the secondary transfer nip. As another configuration example, such a line sensor (belt position detection section 80) may be arranged as a sheet position detection section (hereinafter, referred to as position detection sensor 80) so as to detect the side end of sheet S at the secondary transfer nip.

As a specific example of this case, when the position of the side end of sheet S detected by position detection sensor 80 is misaligned from the reference position ($TP_0$), control section 100 determines that intermediate transfer belt 421 is also misaligned by the same amount, displaces also the reference position of the side end of sheet S detected by line sensor 54 from the reference position ($TP_0$) by the amount of the misalignment, and displaces registration roller pair 53*a*. Control section 100 operates belt position correction section 90 so as to return the position of the side end of sheet S at the secondary transfer nip detected by position detection sensor 80 to the reference position ($TP_0$), and controls the displacement (amount and speed) of registration roller pair 53*a* so that the position of the side end of sheet S detected by line sensor 54 also approaches the reference position ($TP_0$) as the position of the side end approaches the reference position ($TP_0$). In this manner, in the control of keeping the side end of sheet S at the secondary transfer nip at a certain position, the displacement amount of registration roller pair 53*a* is usually very small. However, such small amount of displacement also effectively acts as a regulating force for suppressing the occurrence of positional misalignment of intermediate transfer belt 421.

In the above-described embodiment, a case has been described in which control section 100 determines the end position (the presence or absence of a positional misalignment and the misalignment direction) of intermediate transfer belt 421 at the secondary transfer nip on the basis of the detection result of belt position detection section 80, to perform control of belt position correction section 90, the change of the target position of sheet S, or the like. As another example, control section 100 can determine the presence or absence of the positional misalignment and the misalignment direction of intermediate transfer belt 421 on the basis of the signal of detection of the torque of a drive source (such as a motor) that drives intermediate transfer belt 421, to perform control of belt position correction section 90, change of the target position of sheet S, or the like. In this case, control section 100 controls belt position correction section 90 so as to move intermediate transfer belt 421 in a direction in which the torque fluctuation amount of the motor or the like described above decreases, for example, thereby correcting the positional misalignment of intermediate transfer belt 421.

In the above-described embodiment, basically, control is performed in which the position correction of intermediate transfer belt 421 in the width direction (so-called belt steering) is performed by belt position correction section 90, and registration roller pair 53*a* is displaced (follows) along with the position correction operation. In other words, it is assumed that the positional misalignment of intermediate transfer belt 421 is basically corrected completely by the operation of belt position correction section 90.

On the other hand, it turned out that, depending on the sheet type of sheet S, in a case of sheet S having a large amount of deformation of the secondary transfer nip such as a thick sheet, the offset of intermediate transfer belt 421 may not be corrected completely only by the belt steering by belt position correction section 90. According to the experimental results of the inventors of the present invention, when sheet S so-called super-thick sheet having a basis weight of 301 g/m$^2$ or more is used, offset of intermediate transfer belt 421 cannot be corrected completely at the time of belt steering by belt position correction section 90.

Therefore, in such a case, in the displacement control of registration roller pair 53*a* to follow the position correction (belt steering) of intermediate transfer belt 421 by belt position correction section 90, control section 100 applies a correction value of the displacement amount or the displacement speed depending on the sheet type of sheet S. That is, in general, as the thickness of sheet S is thicker, the sheet hardens (stiffness increases), so that it is possible to transmit the stress at the time of displacement of registration roller pair 53*a* to intermediate transfer belt 421 via sheet S. Therefore, the insufficiency or defect of the steering function by belt position correction section 90 can be suppled or compensated by the displacement of registration roller pair 53*a*, in other words, a belt steering function by the displacement of registration roller pair 53*a* can be included.

Such displacement control to which the correction value is applied can enhance the position (alignment) adjustment function of intermediate transfer belt 421 in the width direction while securing the sheet type of sheet S to be used.

The belt steering effect due to the displacement of registration roller pair 53*a* is effectively exhibited in the case where the sheet type of sheet S is not only the super thick sheet described above but also a normal paper or thick sheet. According to the experimental results by the present inventors, when the basis weight of sheet S is in the range of 53 to 300 g/m$^2$ (normal paper or thick sheet), due to the belt steering effect using displacement of registration roller pair 53*a* and sheet S, the positional misalignment of intermediate transfer belt 421 can be corrected without using belt position correction section 90 (steering roller 423S). Therefore, in the case where sheet S is a normal paper or thick sheet (in an example, sheet type having a basis weight of 53 to 300 g/m$^2$), after sheet S enters the secondary transfer nip, control section 100 may cause the operation of belt position correction section 90 (steering roller 423S) (belt steering function) to be automatically set to off.

On the other hand, when sheet S is a thin sheet, since the sheet is softer as the thickness is thinner in general, the belt steering effect due to the displacement of registration roller pair 53*a* may be reduced in some cases. Therefore, when sheet S is a thin sheet (in an example, the basis weight is 52 g/m$^2$ or less), control section 100 may not correct the reference position ($TP_0$) of the side end of sheet S after sheet S enters the secondary transfer nip.

In general, a user may select the mode of ON (sheet feed is prioritized) or OFF (steering is prioritized) of the belt steering function (that is, application of the correction value) due to the displacement of registration roller pair 53*a* described above, through a user setting screen or the like.

In the above-described embodiment, an example of an image forming apparatus having the transfer section that secondarily transfers an image to be printed onto sheet S by using intermediate transfer belt 421 as a transfer body has been described. On the other hand, the above embodiment can be similarly applied to an image forming apparatus of a system in which an image to be printed is primarily transferred onto sheet S (for example, a transfer drum type printer, or the like).

In the above-described embodiment, a case has been described in which the sheet conveyance member provided on the upstream side of the secondary transfer nip and displacement-controlled by control section 100 is registration roller pair 53*a*. As another example, the sheet conveyance member may additionally or alternatively be, for example, a roller other than registration roller pair 53*a*, a sheet conveyance guide, or the like.

In the above-described embodiment, a case in which a sheet paper is used as sheet S has been described. On the other hand, the above embodiment can also be similarly applied to a roll paper.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus, comprising:

a transferer comprising a transfer body that transfers an image onto a sheet at a transfer position;

a transfer body position corrector that performs operation of correcting misalignment of a position in an axial direction of the transfer body at the transfer position;

a sheet conveyance member that is provided on an upstream side of the transfer position in a sheet conveyance direction and conveys the sheet; and a hardware processor that controls the sheet conveyance member so as to displace the sheet along a width direction of the sheet, wherein the hardware processor controls displacement of the sheet conveyance member so as to follow the position in the axial direction of the transfer body at the transfer position.

2. The image forming apparatus according to claim 1, wherein the hardware processor controls the displacement of the sheet conveyance member so as to align a side end of the sheet with a target position, and changes the target position in the same direction as a direction of the misalignment of the transfer body.

3. The image forming apparatus according to claim 1, further comprising a transfer body position detector that detects the position in the axial direction of the transfer body at the transfer position, wherein the hardware processor specifies the direction of the misalignment of the transfer body on the basis of a detection result by the transfer body position detector.

4. The image forming apparatus according to claim 1, further comprising a sheet position detector that detects a position of a side end of the sheet at the transfer position, wherein the hardware processor specifies the direction of the misalignment of the transfer body on the basis of a detection signal by the sheet position detector.

5. The image forming apparatus according to claim 4, wherein the hardware processor controls the transfer body position corrector so that a difference between the side end of the sheet at the transfer position and a reference position becomes smaller, on the basis of the detection signal by the sheet position detector.

6. The image forming apparatus according to claim 1, wherein the hardware processor changes a displacement mode of the sheet conveyance member according to a type of the sheet.

7. The image forming apparatus according to claim 1, wherein the hardware processor changes a displacement mode of the sheet conveyance member according to temperature and humidity around the image forming apparatus.

8. The image forming apparatus according to claim 1, wherein the hardware processor changes a displacement mode of the sheet conveyance member according to a deterioration situation of the sheet conveyance member.

9. The image forming apparatus according to claim 3, wherein, after the sheet enters the transfer position, the hardware processor controls the displacement of the sheet conveyance member on the basis of the detection result by the transfer body position detector and the detection result by a line sensor that detects a position of the side end of the sheet on the upstream side of the transfer position in the sheet conveyance direction.

10. The image forming apparatus according to claim 9, wherein, before the sheet enters the transfer position, the hardware processor controls the displacement of the registration roller so as to align the side end of the sheet with the target position on the basis of the detection result by the line sensor.

11. The image forming apparatus according to claim 10, wherein the hardware processor switches performing or non-performing of operation of the transfer body position corrector after the sheet enters the transfer position, according to the type of the sheet.

12. A conveyance control method in an image forming apparatus, the image forming apparatus comprising: a transferer comprising a transfer body that transfers an image onto a sheet at a transfer position; a transfer body position corrector that performs operation of correcting misalignment of a position in an axial direction of the transfer body at the transfer position; and a sheet conveyance member that is provided on an upstream side of the transfer position in a sheet conveyance direction and conveys the sheet, the method comprising:

detecting the position in the axial direction of the transfer body at the transfer position; and displacing the sheet conveyance member so as to follow the detected position.

* * * * *